US011877625B2

(12) United States Patent
Brown

(10) Patent No.: US 11,877,625 B2
(45) Date of Patent: Jan. 23, 2024

(54) IMPACT ABSORBING FOOTWEAR PROTRUSION

(71) Applicant: Worcester Polytechnic Institute, Worcester, MA (US)

(72) Inventor: Christopher A. Brown, Waterbury Center, VT (US)

(73) Assignee: Worcester Polytechnic Institute, Worcester, MA (US)

( * ) Notice: Subject to any disclaimer, the term of this patent is extended or adjusted under 35 U.S.C. 154(b) by 0 days.

(21) Appl. No.: 16/568,839

(22) Filed: Sep. 12, 2019

(65) Prior Publication Data

US 2020/0077743 A1 Mar. 12, 2020

Related U.S. Application Data

(60) Provisional application No. 62/730,182, filed on Sep. 12, 2018.

(51) Int. Cl.

| | |
|---|---|
| ***A43C 15/16*** | (2006.01) |
| ***A43C 15/14*** | (2006.01) |
| ***A43B 13/26*** | (2006.01) |

(52) U.S. Cl.

CPC ..... *A43C 15/161* (2013.01); *A43B 13/26* (2013.01); *A43C 15/14* (2013.01); *A43C 15/168* (2013.01)

(58) Field of Classification Search

CPC ..... A43C 15/005; A43C 15/08; A43C 15/14; A43C 15/161; A43C 15/162;

(Continued)

(56) References Cited

U.S. PATENT DOCUMENTS 3,331,148 A * 7/1967 Hollister ..... A43C 15/161 36/67 A
3,522,669 A * 8/1970 Morris ..... A43B 5/00 36/67 A (Continued)

FOREIGN PATENT DOCUMENTS

GB 2 264 627 A 9/1993
GB 2492864 A 1/2013

(Continued)

OTHER PUBLICATIONS

International Search Report, PCT/US2019/050779, dated Dec. 19, 2019, pp. 2.

*Primary Examiner* — Khoa D Huynh
*Assistant Examiner* — Haley A Smith
(74) *Attorney, Agent, or Firm* — Armis IP Law, LLC

(57) ABSTRACT

A force absorbing device for a footwear appliance includes a shoe sole having a planar sole surface, such that the shoe sole is adapted to be disposed against a ground surface such as turf, grass or dirt. A ground interface member having a general appearance of a footwear cleat extends from the planar sole surface. Within the sole, the ground interface member couples to a force mitigation assembly for absorbing forces against the cleat. The force mitigation assembly includes an elastic field of a resilient, compressible material, and an inclined surface is disposed against the elastic field and oriented to compress the elastic field. A linkage or connecting surface transmits a displacement force for disposing the inclined surface across the elastic field, where the inclined surface compresses the elastic field as it moves across. In response, the elastic field exerts a counterforce against the ground interface member.

12 Claims, 5 Drawing Sheets

(58) Field of Classification Search
CPC ... A43C 15/164; A43C 15/167; A43C 15/168; A43C 15/18; A43B 5/02; A43B 13/223; A43B 13/24; A43B 13/26; A43B 13/184
See application file for complete search history.

(56) References Cited

U.S. PATENT DOCUMENTS

| | | | | |
|---|---|---|---|---|
| 5,197,210 | A * | 3/1993 | Sink | A43B 13/26 36/127 |
| 5,502,901 | A | 4/1996 | Brown | |
| 5,661,927 | A | 9/1997 | Polowinczak et al. | |
| 6,378,169 | B1 | 4/2002 | Batten et al. | |
| 6,684,531 | B2 | 2/2004 | Rennex | |
| 7,013,581 | B2 | 3/2006 | Greene et al. | |
| 7,140,124 | B2 | 11/2006 | Manz et al. | |
| 8,261,469 | B2 | 9/2012 | Aveni et al. | |
| 9,113,676 | B2 * | 8/2015 | Campbell | A43B 13/26 |
| 9,339,074 | B2 | 5/2016 | Ellis | |
| 9,516,918 | B2 * | 12/2016 | Meschter | A43C 15/14 |
| 9,693,605 | B2 | 7/2017 | Beers | |
| 10,244,821 | B2 | 4/2019 | Elder et al. | |
| 2010/0122471 | A1 | 5/2010 | Edington et al. | |
| 2014/0310995 | A1 * | 10/2014 | Campari | A43C 15/14 36/134 |
| 2014/0345164 | A1 * | 11/2014 | Campbell | A43C 15/161 36/103 |
| 2015/0040435 | A1 | 2/2015 | Barnes et al. | |
| 2015/0196087 | A1 * | 7/2015 | Meschter | A43B 13/188 36/25 R |
| 2018/0042339 | A1 | 2/2018 | Barnes et al. | |
| 2018/0140043 | A1 | 5/2018 | Farris et al. | |

FOREIGN PATENT DOCUMENTS

| | | | | |
|---|---|---|---|---|
| KR | 101291244 | B1 | 7/2013 | |
| WO | WO 2007/044451 | A1 | 4/2007 | |
| WO | WO-2010133454 | A1 * | 11/2010 | A43C 15/167 |
| WO | WO 2012/045512 | A1 | 4/2012 | |
| WO | WO 2012/059142 | A1 | 5/2012 | |

* cited by examiner

IMPACT ABSORBING FOOTWEAR PROTRUSION

RELATED APPLICATIONS

This patent application claims the benefit under 35 U.S.C. § 119(e) of U.S. Provisional Patent App. No. 62/730,182 filed Sep. 12, 2018, entitled "IMPACT ABSORBING FOOTWEAR PROTRUSION," incorporated herein by reference in entirety.

BACKGROUND

Athletic injuries, such as from overstressed musculoskeletal structures, can be traumatic and career ending. ACL (anterior cruciate ligament) injuries are particularly notorious and prone to recurrence. These and other injuries often result from some form of loads (e.g., forces and torques) transferred through the footwear of the athlete to the foot and on to an anatomical member, such as, a bone, ligament, cartilage, tendon or other tissue structure. Mitigation of the transfer of these loads can substantially eliminate or alleviate injury risk to the foot, ankle, lower leg and knee. Because an athlete's footwear defines the ground interface, the footwear defines the focal point of potentially injurious load transfers. Protruding cleats are often used on the bottom of shoes used sports played on fields, grass, turf or dirt. These protrusions increase the load transfer from the athletes to the playing surface and can, unmitigated, raise the loads to those that can cause injury.

SUMMARY

A force absorbing device for a footwear appliance includes a shoe upper and a shoe sole having a planar sole surface, such that the shoe sole is adapted to be disposed between the shoe upper and a ground surface such as turf, grass or dirt. A ground interface member having a general appearance of a footwear cleat extends from the planar sole surface. Within the sole of the shoe, the ground interface member couples to a force mitigation assembly for absorbing forces against the cleat, as is common in contact sports such as soccer, football and baseball. The force mitigation assembly includes an elastic field of a resilient, compressible material, and an inclined surface is disposed against the elastic field and oriented to compress the elastic field in response to a lateral displacement across the field. A linkage or connecting surface transmits a displacement force from the ground interface member for disposing the inclined surface across the elastic field, where the inclined surface compresses the elastic field as it moves across. In response, the elastic field exerts a counterforce against the ground interface member.

Configurations herein are based, in part, on the observation that energetic contact sports such as soccer, football and baseball often involve sudden and dynamic movement of an athlete's legs and feet against a playing surface, typically turf or grass. Unfortunately, conventional athletic footwear suffers from the shortcoming that forces imposed on the foot from sudden direction changes against the turf are transferred directly to the foot with little or no mitigation or absorption of force by the footwear. Protrusions such as cleats on the bottom footwear surface compound these forces. Accordingly, configurations herein substantially overcome the shortcomings of conventional athletic footwear by providing a force mitigation device or assembly on each cleat of an athletic footwear appliance. Each cleat, defined by a protrusion on the bottom sole surface of the footwear, engages an elastic field defining a constant force spring for mitigating the force of the cleat against the playing surface and allowing the cleat to dispose slightly by deformation of the elastic field and accommodate the force over a distance, thus decreasing the peak force or impact that would otherwise be transferred to the skeletal and anatomical structures of the foot and ankle. Resilience and size of the elastic field moderates the permitted displacement so a loss of athletic control is avoided, and the resilience of the elastic field allows the cleat to return to a normal rest or undeformed position shortly following mitigation of the force.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

and

Figure 8:
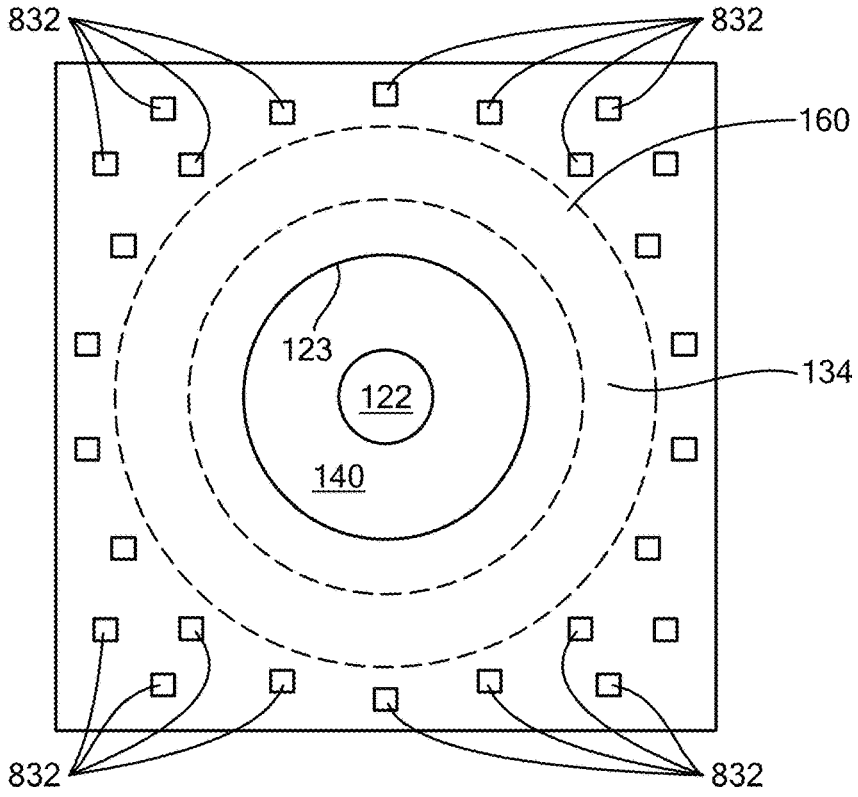

FIG. 8 shows a network of resilient beams defining the elastic field.

DETAILED DESCRIPTION

The description below presents an example of a footwear appliance, or shoe, for implementing the disclosed force mitigation device using a constant force, or substantially constant force spring structure for mitigating harmful transmission of forces though athletic cleats. The assembly including the constant force spring implements an elastic field approach where a counterforce is based on an area of the engaged elastic field, rather than a length of an elongated or contracted spring. The disclosed elastic field constant force spring for exerting a linear force response is also applicable in alternate contexts without departing from the claimed approach.

Figure 1A:
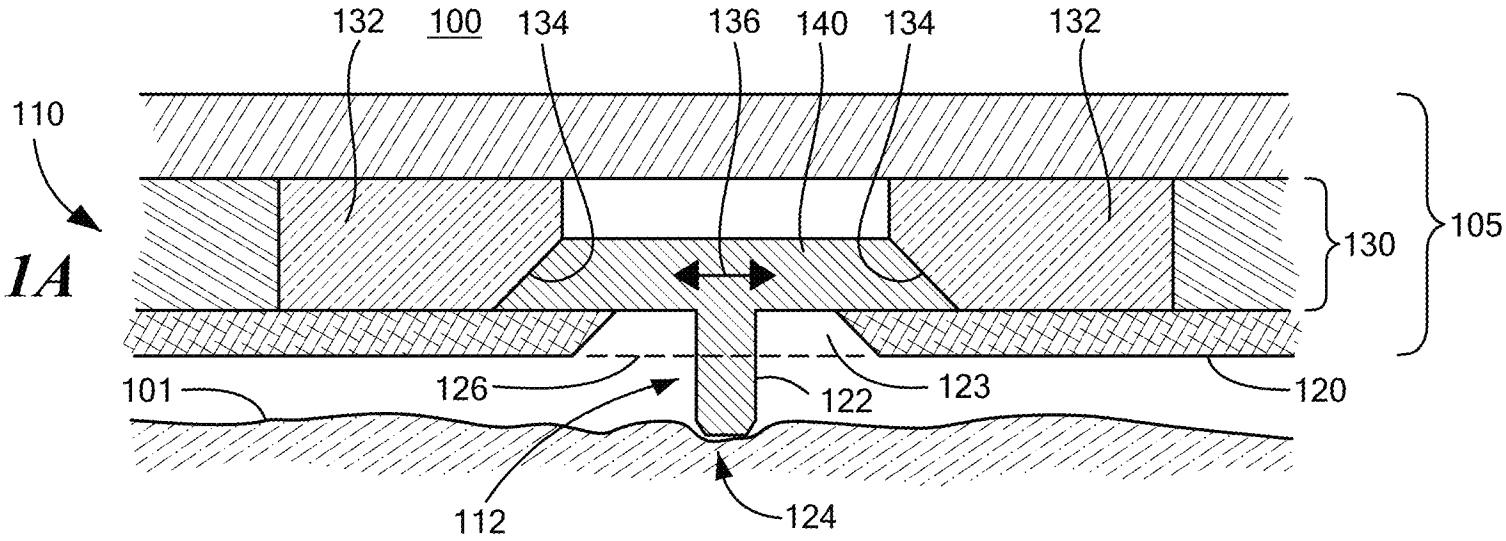
FIG. 1A is a side cutaway view of the force mitigation device.

FIG. 1A is a side cutaway view of the force mitigation device disposed in an athletic footwear appliance, commonly referred to as a shoe. The athletic footwear appliance 100 is typically employed for engaging a planar sole surface 120 with a playing surface 101 in a high impact manner responsive to competitive athletic activities. A ground interface 112 of the footwear appliance 100 has a force mitigation device 110 including a ground interface member 122 extending from the planar sole surface 120. The ground interface member 122 couples to a force mitigation assembly 130, which includes an elastic field 132 of a resilient, compressible material, and an inclined surface 134 disposed against the elastic field 132 and oriented to compress the elastic field 132 in response to a lateral displacement across the field. A linkage, shown by arrow 136, transmits a displacement force from the ground interface member 122 for disposing the inclined surface 134.

Conventional approaches employ "cleats"—a footwear or sneaker upper with a rigid arrangement of plastic, rubber or metal spikes or barbs extending from the underside. This rigid arrangement yields little in the event of impactful or high energy activities. In contrast, in the configurations herein, the ground interface member 122 receives the displacement force from the ground, turf, or other playing surface in response to a forceful athletic maneuver common in such sports.

The ground interface member 122 extends from a surface of a planar member 140 which is slideably disposed in communication with the elastic 132 field for receiving lateral forces from the ground interface member 122. The ground interface member 122 further comprises a protrusion 124 beyond a plane 126 defined by the planar sole surface 120. The linkage further comprises an attachment of the ground interface member 122 to the slideable planar member 140 retained within the sole 105 by the planar sole surface 120 for movement parallel to the planar sole surface. The inclined surface 134 is defined by a circumferential edge of the planar member 140, discussed further below in FIG. 3.

Figure 1B:
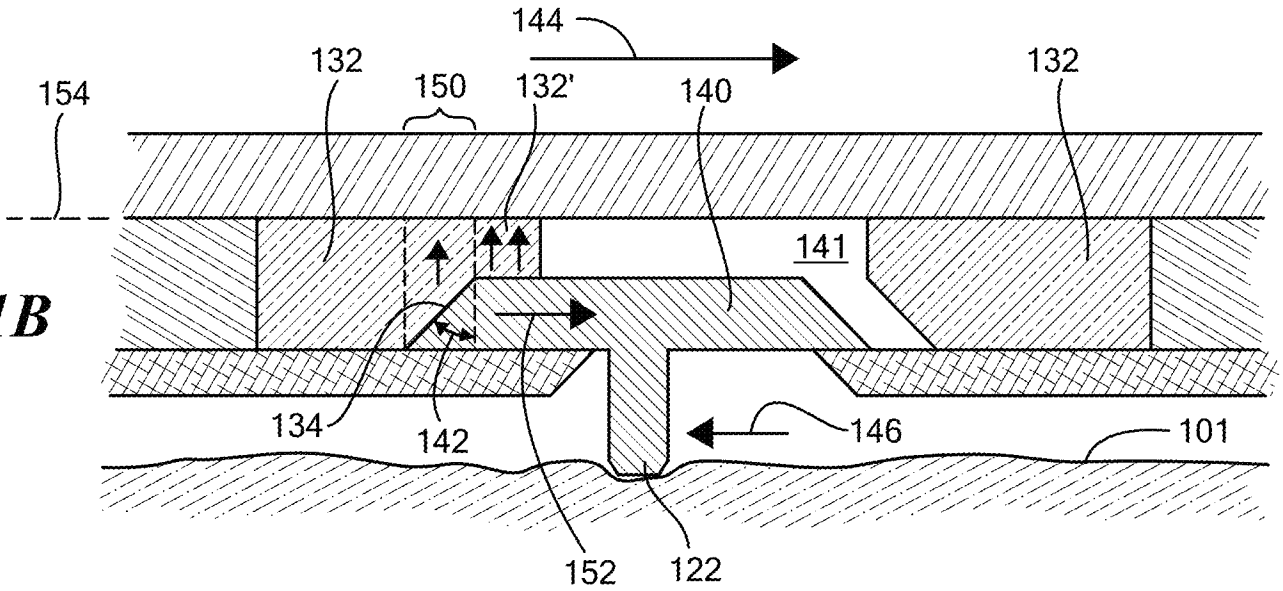
FIG. 1B is a side cutaway of the force mitigation device of claim 1 under load.

FIG. 1B is a side cutaway of the force mitigation device 110 under load. In operation, the footwear appliance 100 is thrust against the playing surface 101 in the direction of arrow 144. Friction and interference with the playing surface 101 cause a displacement force in the direction of arrow 146. Referring to FIGS. 1A and 1B, the inclined surface 134 is oriented at an angle 142 from the displacement force 146, such that the angle 142 defines a direction for compressing the elastic field 132. The inclined surface 134 is oriented as an inclined plane at an angle 142 that directs a component of the displacement force perpendicularly into a plane 154 defined by the elastic field 132 for opposing the displacement force 146.

The linkage 136 transfers the displacement force 146 through the planar member 140 to the inclined surface 134, which compresses the elastic field in a compression region 150. As the planar member 140 is disposed, it displaces the elastic field 132, which remains compressed 132' as further displacement continues in the compression region 150. The inclined surface 134 therefore defines a constant compression region 150 based on an area of the elastic field responsive to compression from displacement of the inclined surface 134. The elastic field 132 therefore defines a plane 154 parallel to the sole surface 120, such that the linkage 136 is adapted to transmit the displacement force 146 parallel to the sole surface 120, The inclined surface 134 is responsive to compresses the elastic field 132 in a direction perpendicular to the sole surface 120 for opposing the displacement force 146. A displacement gap 123 accommodates travel of the ground interface member 122 while retained by the sole surface 120, and a beveled edge prevents entry of dirt and debris from ground contact.

Since the compression region 150 remains invariant regardless of the displacement distance over the already compressed elastic field 132, a mitigating force 152 remains substantially constant, which effectively distributes the displacement force 146 over time and reduces a peak force that tends to cause injury. Once the displacement force 146 subsides, the reverse reaction causes the elastic field 132' to decompress and restore the ground interface member 122 to a rest position as the planar member 140 centers. A void region 141 may appear in response to vacated space from planar member displacement which is reoccupied when the displacement force subsides.

The elastic field 132 may be any suitable deformable and/or resilient material that compresses based on the sliding displacement of the inclined surface 134 driven by the planer member 140. Material characteristics of the elastic field, such as compressibility and rigidity, will affect a displacement distance of the planer member 140, the mitigating force 152, and the time to recenter. Elastomeric, rubber and/or foam materials may provide suitable material characteristics.

Figure 2A:
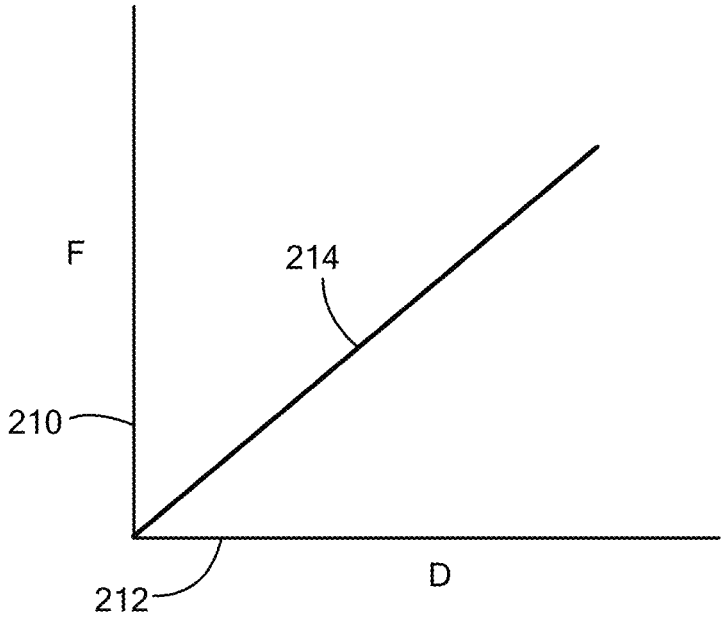
FIG. 2A (Prior Art)
FIG. 2A is a graph of prior art force displacement performance.

FIG. 2A is a graph of prior art force displacement performance. In a conventional spring approach, a force 210 of an extended spring increases with the displacement 212 of the spring (line 214). An increasing level of force is required to continue displacement of an object connected to the spring, and a complementary return force is encountered upon release.

Figure 2B:
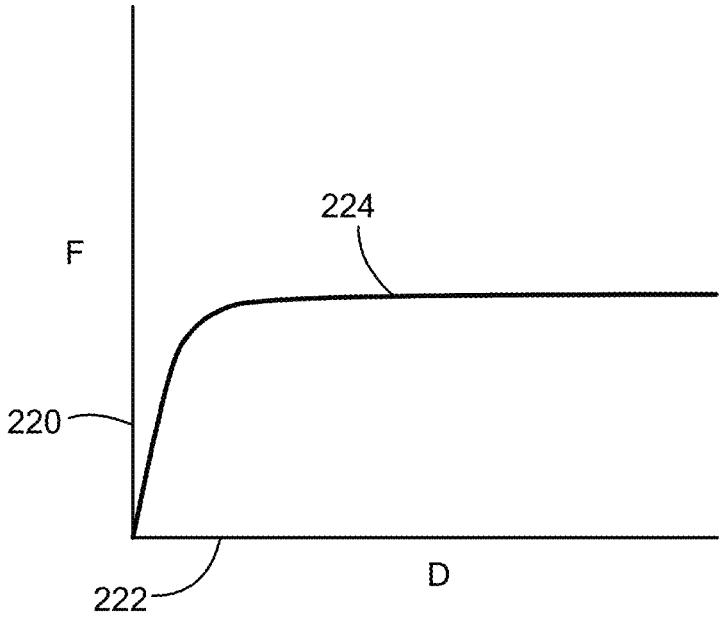
FIG. 2B is a graph of a constant force spring response as defined herein.

FIG. 2B is a graph of a constant force spring response as defined herein. The elastic field 132, in contrast to the spring of FIG. 2A, defines a constant force spring such that the force 220 required for displacement 222 remains substantially constant over the displacement distance, graphed as line 224 (following an initial compression period). With reference to the assembly in FIGS. 1A and 1B, the elastic field 132 imposes a resistance to the displacement force 146 in a load (compression) region 150 defined by the area of the elastic field 132 opposed from the inclined surface 134.

Since the area of the inclined surface 134 remains substantially constant, the same volume of the elastic field 132 is compressed at any given displacement, therefore the return force (mitigating force 152) remains substantially constant. Displacement of the inclined surface 134 across the elastic field 132 defines a constant force. This force from the elastic field is independent of the displaced distance based on a constant compression region 150 of the elastic field 132 engaging the inclined surface opposing the elastic field 132. The amount/distance of previously compressed elastic field 132' does not apply additional force to the inclined surface 134. Small deviations may occur for residual friction from the already compressed 132' field, but these can be accommodated by consideration of surface friction and appropriate material selection.

Figure 3:
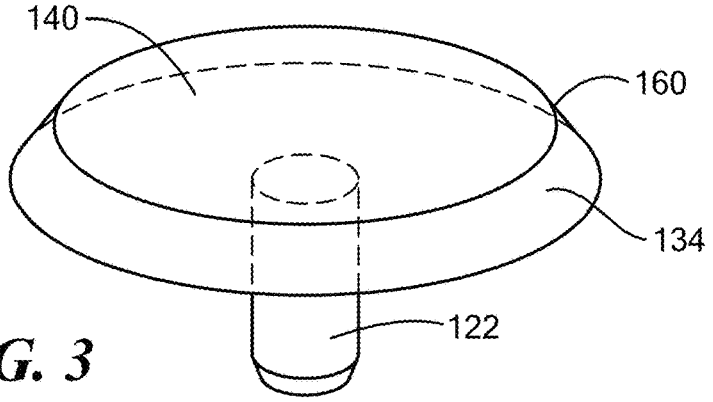
FIG. 3 is a perspective view of the ground interface member of FIGS. 1A and 1B.

FIG. 3 is a perspective view of the ground interface member of FIGS. 1A and 1B. Referring to FIGS. 1A, 1B and 3, the linkage 136 is defined by the planar member 140 disposed between the planar sole surface 120 and an upper region adapted for engaging a user foot. The planar member 140 is adapted to receive the displacement force 146 defined by a component of an impact force transmitted from the ground interface member 122 in a direction parallel to the planar sole surface 120. The ground interface member 122 and planar member 140 may be a single assembly defining the linkage 136 for transferring the displacement force 146 to the elastic field 132. The inclined surface 134 is defined by an annular circumference 160 around the planar member 140 slideably disposed between the sole surface 120 and the upper footwear appliance 100. The inclined surface 134 opposes the displacement force from compression in a direction perpendicular to the planar sole surface 120. In the example approach, the inclined angle 142 is oriented substantially around 45 degrees from parallel to the sole surface 120, however other suitable angles for compressing the elastic field 132 may be employed.

Figure 4:
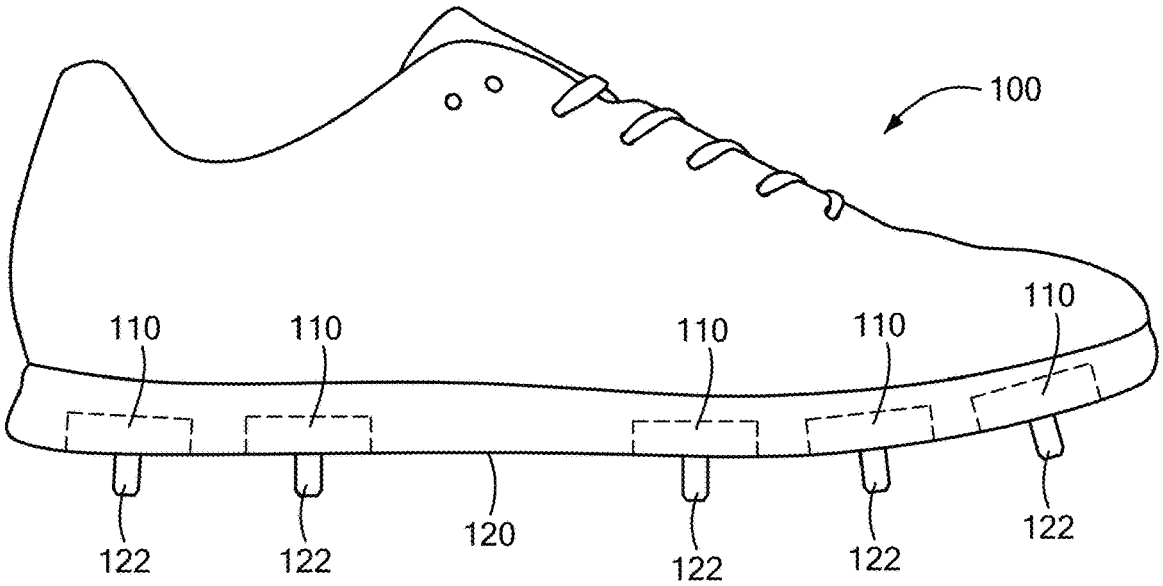
FIG. 4 is a side view of a plurality of force mitigation devices disposed in an athletic footwear appliance
Figure 5:
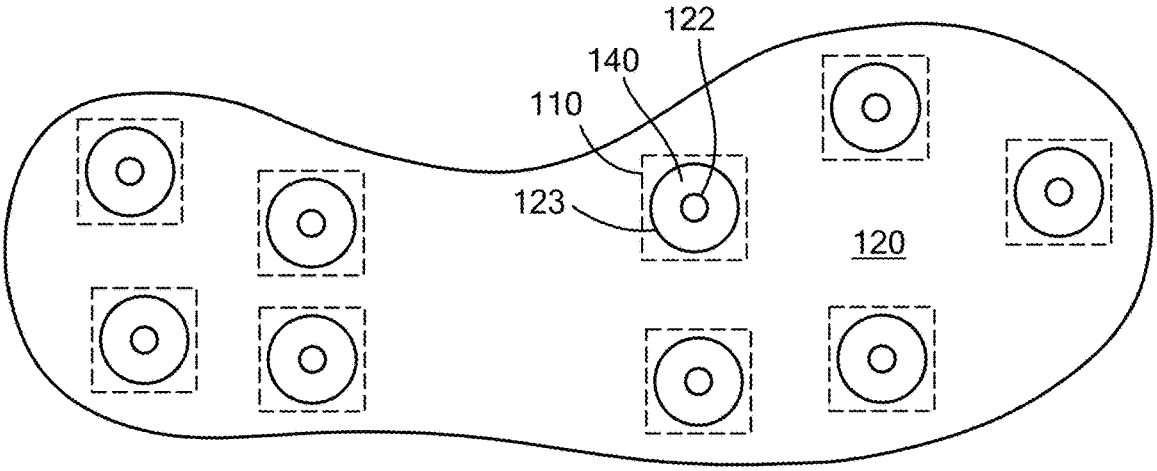
FIG. 5 is a bottom view of the athletic footwear appliance of FIG. 4.

FIG. 4 is a side view of a plurality of force mitigation devices 110 disposed in an athletic footwear appliance 100, and FIG. 5 is a bottom view of the athletic footwear appliance of FIG. 4. Referring to FIGS. 1A, 4 and 5, a plurality of the devices 110 may be arranged in a similar manner as cleats in a conventional approach, and embedded in the sole 105 of the footwear appliance 100. In the footwear appliance 100, the ground interface member 122 extends in a downward direction substantially perpendicular to the planar sole surface 120 and is adapted to focus a concentrated force for deformation and friction exerted against a playing surface 101. The force mitigation devices 110 remain largely obscured from view within the sole, and the ground interface member 122 remains visible along with a portion of the planar member 140 visible around the displacement gap 123 of the ground interface member 122.

Figure 6A:
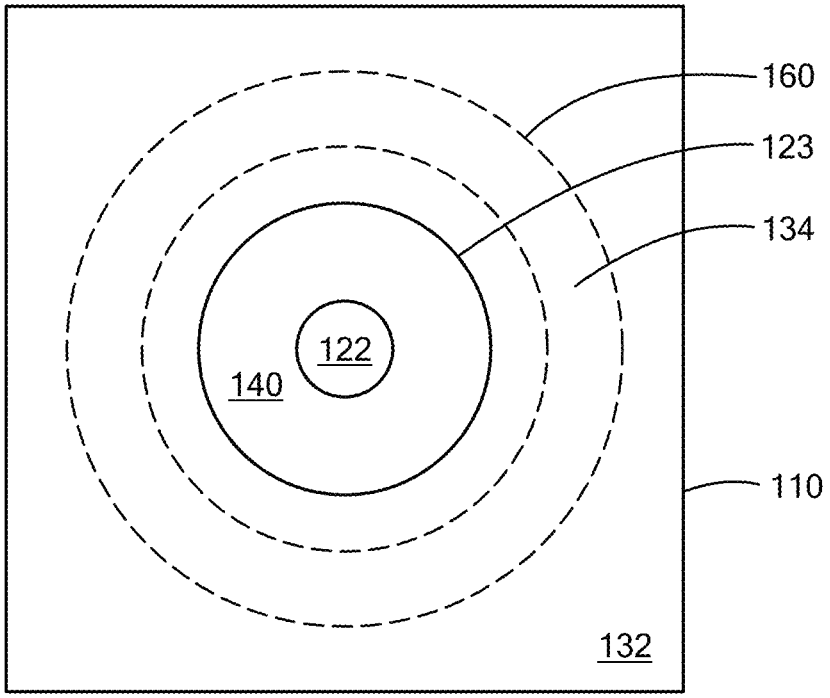
FIG. 6A shows a top schematic view of the force mitigation device.

FIG. 6A shows a top schematic view of the force mitigation device. Referring to FIGS. 1A, 1B, 3 and 6A, at a rest position the ground interface member 122 is substantially centered within the displacement gap 123. The outer circumference 160 of the planar member 140 abuts the elastic field 132.

Figure 6B:
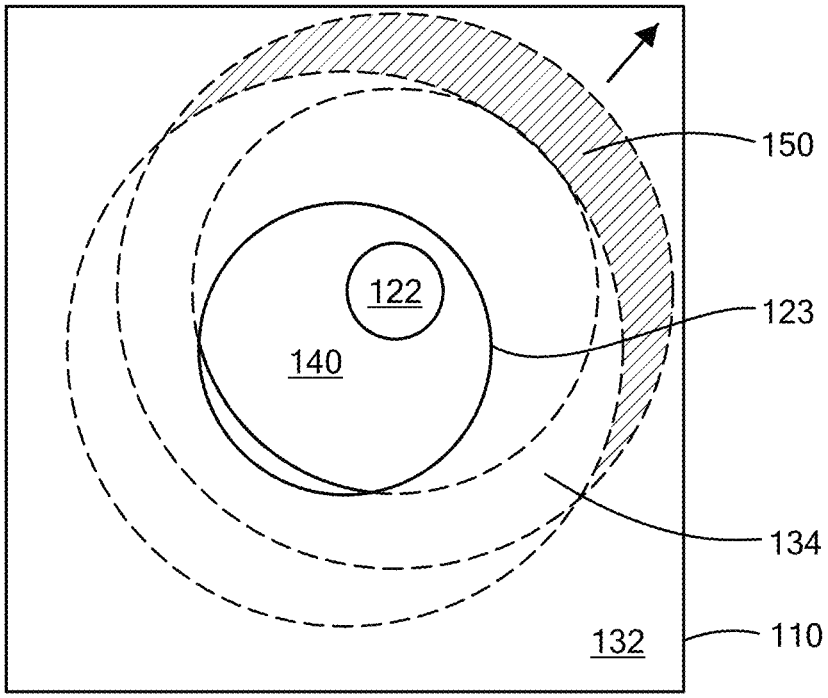
FIG. 6B shows the force mitigation device of FIG. 6A under load.

FIG. 6B shows the force mitigation device of FIG. 6A under load. Responsive to the displacement force 146, the inclined surface 134 counters the displacement force with a counterforce proportional to the compression region 150 of the elastic field 132. As the force against the ground interface member 122 displaces the planar member 140, the ground interface member 122 moves off center, approaching the edge of the displacement gap 123 as the inclined surface 134 compresses the elastic field 132 in the hashed area depicting the compression region 150.

Figure 7:
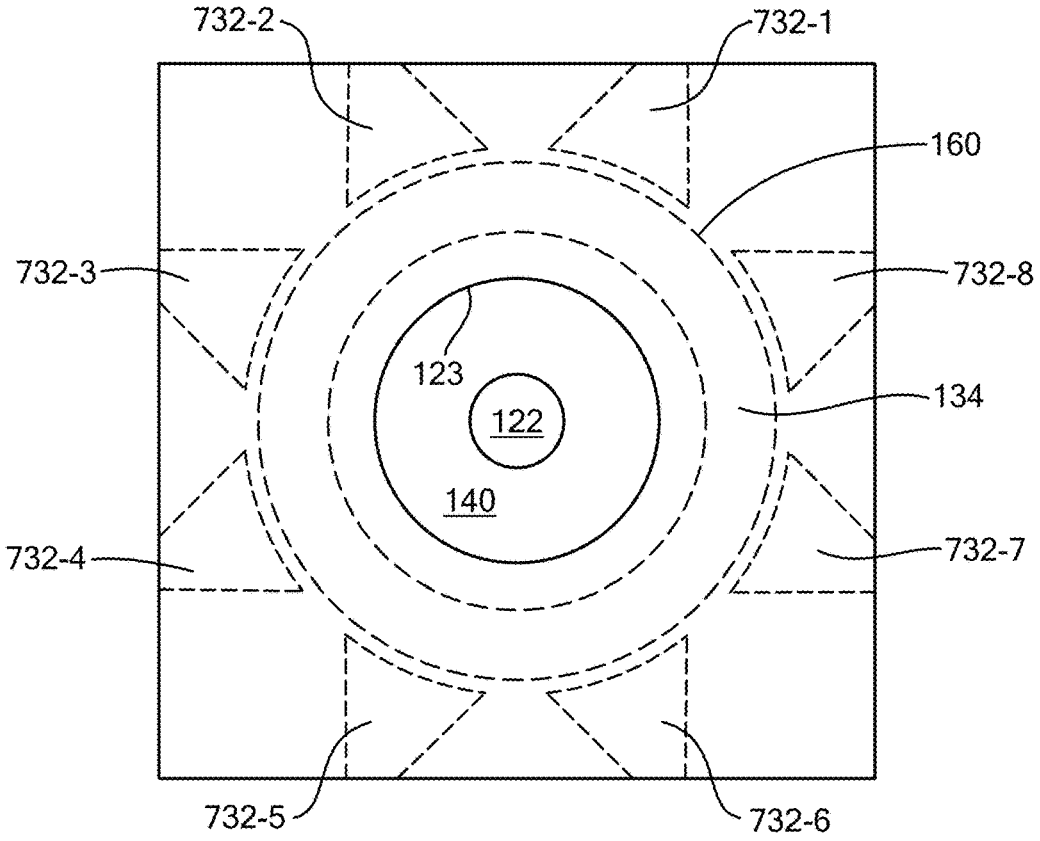
FIG. 7 shows an alternate configuration of the elastic field of FIGS. 6A and 6B.

FIG. 7 shows an alternate configuration of the elastic field of FIGS. 6A and 6B. In FIG. 7, the elastic field 132 is subdivided into portions 732-1 . . . 732-8 (732-N generally). Referring back to FIGS. 1A and 1B, the mitigating force 152 is proportional to the area of the inclined surface that engages the elastic field 132. In the case of the circular shape of the planar member 140, the compression region 150 increases as a greater portion of the circumference 160, and therefore the circumferential inclined area, engages the elastic field 132. The portions 732-N serve to dispose the elastic region in a more linear arrangement so as to remain constant during displacement of the planar member 140. In other words, as the circumference 160 displaces against additional portions 732-N, the width of the portions decreases to maintain the compression region constant.

FIG. 8 shows a network of resilient beams 832 defining the elastic field. Referring to FIGS. 1B and 8, the resilient beams 832 extend perpendicular to and vertically from the planar sole surface 120. Rather than a continuous elastic field 132, the resilient beams 832 react similarly based on the area of engagement with the inclined surface, allowing the mitigating force 152 to be adjusted for proportionality with planar member 140 displacement. Further, the resilient beams can have varied cross section, and therefore respond with a different force curve based on the cross section size, as disclosed further in copending U.S. patent application Ser. No. 15/675,989, filed Aug. 14, 2017, entitled "SELF-RECOVERING IMPACT ABSORBING FOOTWEAR," incorporated herein by reference in entirety. The elastic field 132 may therefore be further defined by a plurality of resilient vertical beams 832 spaced at intervals and responsive to deformation based on displacement of the planar member 140. In general a larger cross section increases the mitigating counterforce. The cross section may be varied to correspond to response thresholds, such as a subtle response to normal "performance" loads, and a more exigent response to relieve a potentially injurious force.

While the system and methods defined herein have been particularly shown and described with references to embodiments thereof, it will be understood by those skilled in the art that various changes in form and details may be made therein without departing from the scope of the invention encompassed by the appended claims.

What is claimed is:

1. In an athletic footwear appliance for engaging a planar sole surface with a playing surface in a high impact manner responsive to competitive athletic activities, a ground interface having a force mitigation device, comprising: a ground interface member extending from the planar sole surface, the ground interface member coupled to a force mitigation assembly, the force mitigation assembly having: an elastic field of a resilient, compressible material; a planar member slidably disposed in communication with the elastic field, the planar member slidably engaged with and directly in contact with the planar sole surface and including an inclined surface around a circumferential edge of the planar member, the inclined surface disposed against the elastic field and oriented to compress the elastic field in a direction perpendicular to the planar sole surface by slidable travel of the planar member along the planar sole surface and between the planar sole surface and the elastic field for disposing the inclined surface in a direction parallel to the planar sole surface in response to receiving a lateral displacement force from the ground interface member, the inclined surface defining a compression region having a constant size resulting from an area moving with the inclined surface from travel of the planar member parallel to the planar sole surface as the inclined surface compresses the compression region in a direction perpendicular to the travel of the planar member; and a linkage for transmitting the lateral displacement force from the ground interference member for disposing the inclined surface to counter the displacement force with a counterforce proportional to the compressed area of the elastic field.

2. The device of claim 1 wherein the inclined surface is oriented at an angle for directing a component of the displacement force, the angle defining a direction for compressing the elastic field.

3. The device of claim 2 wherein the constant compression region exhibits a counterforce to the displacement force, the counterforce independent of the displaced distance.

4. The device of claim 1 wherein the ground interface member further comprises a protrusion beyond a plane defined by the planar sole surface and the linkage further comprises an attachment of the protrusion to the planar member retained within a sole by the planar sole surface for movement parallel to the planar sole surface.

5. The device of claim 1 wherein the inclined surface is oriented at an angle that directs a component of the displacement force perpendicularly into a plane defined by the elastic field for opposing the displacement force.

6. The device of claim 1 wherein the inclined surface is oriented substantially around 45 degrees from parallel to the planar sole surface.

7. The device of claim 1 wherein the elastic field imposes a resistance to the displacement force in a load region defined by the area of the elastic field opposed from the inclined surface.

8. The device of claim 1 wherein the linkage is defined by the planar member disposed between the planar sole surface and an upper region adapted for engaging a user foot, the planar member receiving a displacement force defined by a component of an impact force transmitted to the ground interface member in a direction parallel to the planar sole surface, and the inclined surface opposes the displacement force from compression in a direction perpendicular to the planar sole surface.

9. The device of claim 1 wherein the ground interface member extends in a downward direction substantially perpendicular to the planar sole surface and is adapted to focus a concentrated force for deformation and friction exerted against a playing surface.

10. The device of claim 1 wherein displacement of the inclined surface across the elastic field defines a constant force spring having a constant force independent of the displaced distance based on a constant compression region of the elastic field engaging the inclined surface opposing the elastic field.

11. A force absorbing device for a footwear appliance, comprising: a shoe sole having a planar sole surface, the shoe sole adapted to be disposed between a shoe upper and a ground surface; a ground interface member extending from the planar sole surface, the ground interface member coupled to a force mitigation assembly, the force mitigation assembly having: an elastic field of a resilient, compressible material, a planar member slidably disposed in communication with the elastic field, the planar member slidably engaged with and directly in contact with the planar sole surface, the planar member including an inclined surface around a circumferential edge of the planar member, the inclined surface disposed against the elastic field and oriented to compress the elastic field in a direction perpendicular to the planar sole surface by slidable travel of the planar member along the planar sole surface and between the planar sole surface and the elastic field for disposing the inclined surface in a direction parallel to the planar sole surface in response to receiving a lateral displacement force from the ground interface member, the inclined surface defining a compression region having a constant size resulting from an area moving with the inclined surface from travel of the planar member parallel to the planar sole surface as the inclined surface compresses the compression region in a direction perpendicular to the travel of the planar member; and a linkage for transmitting the lateral displacement force from the ground interface member for disposing the inclined surface to counter the displacement force with a counterforce proportional to the compressed area of the elastic field.

12. A method for receiving and absorbing forces exerted against a footwear appliance, comprising: receiving a displacement force at a ground interface member extending from a planar sole surface of a shoe sole, the ground interface member coupled to a force mitigation assembly, transferring the displacement force via a linkage to a planar member slidably disposed in communication with an elastic field, the planar member slidably engaged with and directly in contact with the planar sole surface; the planar member including an inclined surface around a circumferential edge of the planar member, the inclined surface disposed against the elastic field and oriented to compress the elastic field in a direction perpendicular to the planar sole surface by slidable travel of the planar member along the planar sole surface and between the planar sole surface and the elastic field for disposing the inclined surface in a direction parallel to the planar sole surface in response to receiving a lateral displacement across the field, the inclined surface defining a compression region having a constant size resulting from an area moving with the inclined surface from travel of the planar member parallel to the planar sole surface as the inclined surface compresses the compression region in a direction perpendicular to the travel of the planar member; the elastic field including a resilient, compressible material; and receiving a mitigating force to counter the lateral displacement force with a counterforce proportional to a compressed area of the elastic field based on an area of the elastic field engaged by the inclined surface.

* * * * *